US008008861B2

(12) United States Patent
Kim et al.

(10) Patent No.: US 8,008,861 B2
(45) Date of Patent: Aug. 30, 2011

(54) PLASMA DISPLAY PANEL INCLUDING A PHOSPHOR LAYER HAVING PREDETERMINED CONTENT OF PIGMENT

(75) Inventors: Heekwon Kim, Gumi (KR); Byungho Rhee, Gumi (KR); Jinyoung Kim, Gumi (KR); Gibum Lee, Gumi (KR)

(73) Assignee: LG Electronics Inc., Seoul (KR)

( * ) Notice: Subject to any disclaimer, the term of this patent is extended or adjusted under 35 U.S.C. 154(b) by 324 days.

(21) Appl. No.: 12/165,916

(22) Filed: Jul. 1, 2008

(65) Prior Publication Data

US 2009/0009082 A1 Jan. 8, 2009

(30) Foreign Application Priority Data

Jul. 3, 2007 (KR) ..... 10-2007-0066525

(51) Int. Cl.

| | |
|---|---|
| ***H01J 29/10*** | (2006.01) |
| ***H01J 31/00*** | (2006.01) |
| ***H01J 17/49*** | (2006.01) |
| *H01J 1/62* | (2006.01) |

(52) U.S. Cl. ..... 313/582; 313/583; 313/584; 313/586; 313/587; 428/403; 428/404; 427/217; 427/218

(58) Field of Classification Search ..... 313/581–587
See application file for complete search history.

(56) References Cited

U.S. PATENT DOCUMENTS

| | | | | |
|---|---|---|---|---|
| 5,936,339 | A * | 8/1999 | Hayama et al. | 313/461 |
| 6,020,067 | A * | 2/2000 | Iwama et al. | 428/403 |
| 6,611,099 | B1 | 8/2003 | Murata et al. | 313/582 |
| 2002/0063532 | A1 | 5/2002 | Chen et al. | 315/169.3 |
| 2005/0042364 | A1 | 2/2005 | Lee | 427/58 |
| 2005/0088090 | A1 | 4/2005 | Wu et al. | 313/582 |
| 2007/0001602 | A1* | 1/2007 | Miyake et al. | 313/582 |
| 2007/0228955 | A1* | 10/2007 | Moon | 313/582 |
| 2007/0228956 | A1* | 10/2007 | Bae et al. | 313/582 |

FOREIGN PATENT DOCUMENTS

| | | | |
|---|---|---|---|
| EP | 1 653 496 | A1 | 5/2006 |
| JP | 10-269949 | | 10/1998 |
| KR | 10-2006-0088403 | A | 8/2006 |
| KR | 10-2006-0100177 | A | 9/2006 |

OTHER PUBLICATIONS

Korean Office Action dated Feb. 26, 2008.
European Search Report dated Sep. 17, 2008.

* cited by examiner

*Primary Examiner* — Anne M Hines
*Assistant Examiner* — Tracie Green
(74) *Attorney, Agent, or Firm* — KED & Associates, LLP

(57) ABSTRACT

A plasma display panel is disclosed. The plasma display panel includes a front substrate, a rear substrate facing the front substrate, a barrier rib that is positioned between the front substrate and the rear substrate and partitions a discharge cell, and a phosphor layer formed inside the discharge cell. The phosphor layer includes a first phosphor layer emitting first color light, a second phosphor layer emitting second color light, and a third phosphor layer emitting third color light. The first phosphor layer includes a first pigment. A thickness of the second phosphor layer is larger than a thickness of the first phosphor layer.

17 Claims, 20 Drawing Sheets

| | Phosphor material | Pigment |
|---|---|---|
| First phosphor layer | First phosphor material (Y, Gd)BO:Eu | Red pigment (Fe) |
| Second phosphor layer | Second phosphor material (Ba, Sr, Eu)$MgAl_{10}O_{17}$ | Blue pigment (Co) |
| Third phosphor layer | Third phosphor material ($Zn_2SiO_4$:$Mn^{2+}$ $YBO_3$:$Tb^{3+}$) | |

FIG. 7B

| $t_2/t_1$ | Color representability |
|---|---|
| 0.95 | ○ |
| 1.0 | ◎ |
| 1.01 | ◎ |
| 1.05 | ◎ |
| 1.15 | ◎ |
| 1.25 | ◎ |
| 1.26 | ◎ |
| 1.3 | ○ |
| 1.32 | ○ |
| 1.4 | X |

| | |
|---|---|
| ◎ | : Excellent |
| ○ | : Good |
| X | : Bad |

| | Phosphor material | Pigment |
|---|---|---|
| First phosphor layer | First phosphor material (Y, Gd)BO:Eu | Red pigment (Fe) |
| Second phosphor layer | Second phosphor material (Ba, Sr, Eu)$MgAl_{10}O_{17}$ | Blue pigment (Co) |
| Third phosphor layer | Third phosphor material ($Zn_2SiO_4$:$Mn^{2+}$ $YBO_3$:$Tb^{3+}$) | Green pigment (Zn) |

FIG. 11A

| Content of green pigment | Reflectance |
|---|---|
| 0 | 28% |
| 0.01 | 26.5% |
| 0.05 | 26.2% |
| 0.1 | 26% |
| 0.2 | 25.9% |
| 2.5 | 24.3% |
| 3 | 24% |
| 4 | 23.8% |
| 5 | 23.5% |
| 7 | 22.8% |

PLASMA DISPLAY PANEL INCLUDING A PHOSPHOR LAYER HAVING PREDETERMINED CONTENT OF PIGMENT

This application claims the benefit of Korean Patent Application No. 10-2007-0066525 filed on Jul. 3, 2007, which is hereby incorporated by reference.

BACKGROUND

1. Field

An exemplary embodiment of the invention relates to a plasma display panel.

2. Description of the Related Art

A plasma display panel includes a phosphor layer inside discharge cells partitioned by barrier ribs and a plurality of electrodes.

A driving signal is supplied to the electrodes, thereby generating a discharge inside the discharge cells. When the driving signal generates a discharge inside the discharge cells, a discharge gas filled inside the discharge cells generates vacuum ultraviolet rays, which thereby cause phosphors formed inside the discharge cells to emit light, thus displaying an image on the screen of the plasma display panel.

SUMMARY

An exemplary embodiment of the invention provides a plasma display panel capable of improving a contrast characteristic by reducing the reflection of light caused by a phosphor layer.

An exemplary embodiment of the invention also provides a plasma display panel capable of improving a color temperature characteristic by allowing discharge cells to have different pitches.

In one aspect, a plasma display panel comprises a front substrate, a rear substrate facing the front substrate, a barrier rib that is positioned between the front substrate and the rear substrate and partitions a discharge cell, and a phosphor layer formed inside the discharge cell, the phosphor layer including a first phosphor layer emitting first color light, a second phosphor layer emitting second color light, and a third phosphor layer emitting third color light, wherein the first phosphor layer includes a first pigment, and a thickness of the second phosphor layer is larger than a thickness of the first phosphor layer.

In another aspect, a plasma display panel comprises a front substrate, a rear substrate facing the front substrate, a barrier rib that is positioned between the front substrate and the rear substrate and partitions a discharge cell, and a phosphor layer formed inside the discharge cell, the phosphor layer including a first phosphor layer emitting first color light, a second phosphor layer emitting second color light, and a third phosphor layer emitting third color light, wherein the first phosphor layer includes a first pigment, and a content of the first pigment lies in a range between 0.01 and 5 parts by weight, and a thickness of the second phosphor layer is larger than a thickness of the first phosphor layer.

In still another aspect, a plasma display panel comprises a front substrate, a rear substrate facing the front substrate, a barrier rib that is positioned between the front substrate and the rear substrate and partitions a discharge cell, and a phosphor layer formed inside the discharge cell, the phosphor layer including a first phosphor layer emitting first color light, a second phosphor layer emitting second color light, and a third phosphor layer emitting third color light, wherein the first phosphor layer includes a first pigment, and a thickness of the second phosphor layer is 1.01 to 1.32 times a thickness of the first phosphor layer.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention. In the drawings:

FIGS. 7A and 7B are a graph and a table showing a color temperature and a color representability depending on thicknesses of first and second phosphor layers, respectively;

FIGS. 11A and 11B are a table and a graph showing a reflectance and a luminance of a plasma display panel depending on changes in a content of a green pigment, respectively.

DETAILED DESCRIPTION OF EMBODIMENTS

Reference will now be made in detail embodiments of the invention examples of which are illustrated in the accompanying drawings.

FIGS. 1A to 1D show a structure of a plasma display panel according to an exemplary embodiment of the invention.

Figure 1A:
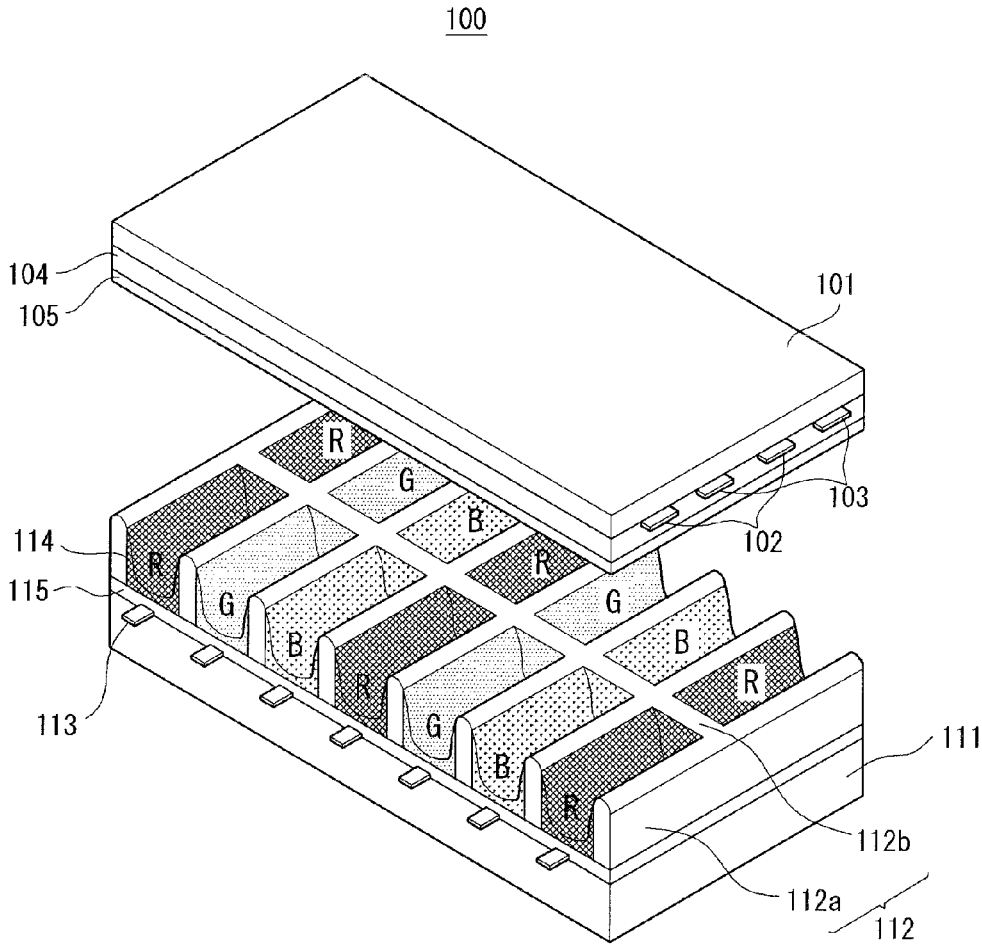
FIGS. 1A to 1D show a structure of a plasma display panel according to an exemplary embodiment of the invention.

As shown in FIG. 1A, a plasma display panel 100 according to an exemplary embodiment of the invention includes a front substrate 101 and a rear substrate 111 which coalesce with each other using a seal layer (not shown) to face each other. On the front substrate 101, a scan electrode 102 and a sustain electrode 103 are formed parallel to each other. On the rear substrate 111, an address electrode 113 is positioned to intersect the scan electrode 102 and the sustain electrode 103.

An upper dielectric layer 104 covering the scan electrode 102 and the sustain electrode 103 is positioned on the front substrate 101 on which the scan electrode 102 and the sustain electrode 103 are positioned.

The upper dielectric layer 104 limits discharge currents of the scan electrode 102 and the sustain electrode 103, and provides electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 covering the address electrode 113 is positioned on the rear substrate 111 on which the address electrode 113 is positioned. The lower dielectric layer 115 provides electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A first discharge cell, a second discharge cell, and a third discharge cell may be positioned between the front substrate 101 and the rear substrate 111.

Each discharge cell partitioned by the barrier ribs 112 is filled with a discharge gas including xenon (Xe), neon (Ne), and so forth.

A phosphor layer 114 is positioned inside the discharge cells to emit visible light for an image display during the generation of an address discharge. For instance, first, second and third phosphor layers respectively emitting red, blue, and green light may be positioned inside the first, second, and third discharge cells, respectively. In addition to the red, green, and blue light, a phosphor layer emitting white or yellow light may be positioned in the discharge cell.

The plasma display panel 100 according the exemplary embodiment may have various forms of barrier rib structures as well as a structure of the barrier rib 112 shown in FIG. 1A. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1A has been shown and described the case where the first, second, and third discharge cells are arranged on the same line, the first, second, and third discharge cells may be arranged in a different pattern. For instance, a delta type arrangement in which the first, second, and third discharge cells are arranged in a triangle shape may be applicable. Further, the discharge cells may have a variety of polygonal shapes such as pentagonal and hexagonal shapes as well as a rectangular shape.

While FIG. 1A has shown and described the case where the barrier rib 112 is formed on the rear substrate 111, the barrier rib 112 may be formed on at least one of the front substrate 101 or the rear substrate 111.

It should be noted that only one example of the plasma display panel according to the exemplary embodiment has been shown and described above, and the exemplary embodiment is not limited to the plasma display panel with the above-described structure. For instance, while the above description illustrates a case where the upper dielectric layer 104 and the lower dielectric layer 115 each have a sing-layered structure, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Figure 1B:
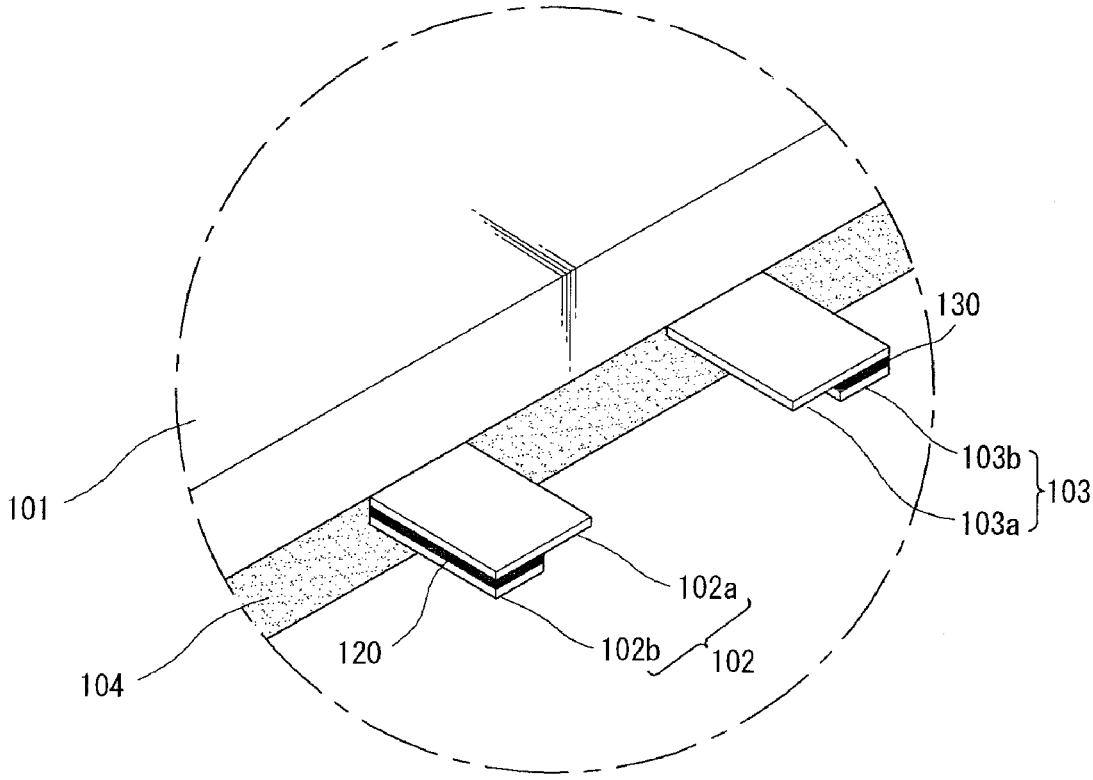

FIG. 1B shows another structure of the scan electrode 102 and the sustain electrode 103.

The scan electrode 102 and the sustain electrode 103 may have a multi-layered structure, respectively. For instance, the scan electrode 102 and the sustain electrode 103 each include transparent electrodes 102*a* and 103*a* and bus electrodes 102*b* and 103*b*.

The bus electrodes 102*b* and 103*b* may include a substantially opaque material, for instance, at least one of silver (Ag), gold (Au), or aluminum (Al). The transparent electrodes 102*a* and 103*a* may include a substantially transparent material, for instance, indium-tin-oxide (ITO).

Black layers 120 and 130 are formed between the transparent electrodes 102*a* and 103*a* and the bus electrodes 102*b* and 103*b* to prevent the reflection of external light caused by the bus electrodes 102*b* and 103*b*.

The transparent electrodes 102*a* and 103*a* may be omitted from the scan electrode 102 and the sustain electrode 103. In other words, the scan electrode 102 and the sustain electrode 103 may be called an ITO-less electrode in which the transparent electrodes 102*a* and 103*a* are omitted.

Figure 1C:
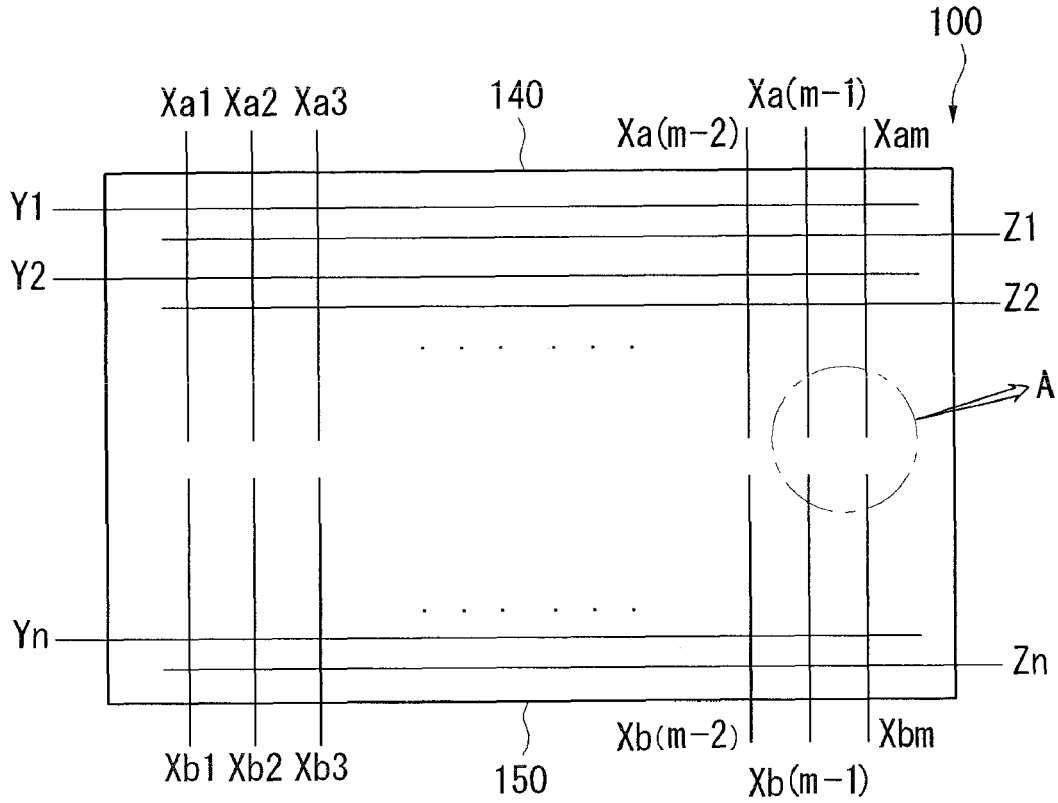

As shown in FIG. 1C, the plasma display panel 100 may be divided into a first area 140 and a second area 150.

In the first area 140, a plurality of first address electrodes Xa1, Xa1, . . . , Xam are positioned parallel to one another. In the second area 150, a plurality of second address electrodes Xb1, Xb1, . . . , Xbm are positioned parallel to one another to be opposite to the plurality of first address electrodes Xa1, Xa1, . . . , Xam.

For example, in case the first address electrodes Xa1, Xa1, . . . , Xam are positioned parallel to one another in turn in the first area 140, the second address electrodes Xb1, Xb1, . . . , Xbm respectively corresponding to the first address electrodes Xa1, Xa1, . . . , Xam are positioned parallel to one another in the second area 150. In other words, the first address electrode Xa1 is opposite to the second address electrode Xb1, and the first address electrode Xam is opposite to the second address electrode Xbm.

Figure 1D:
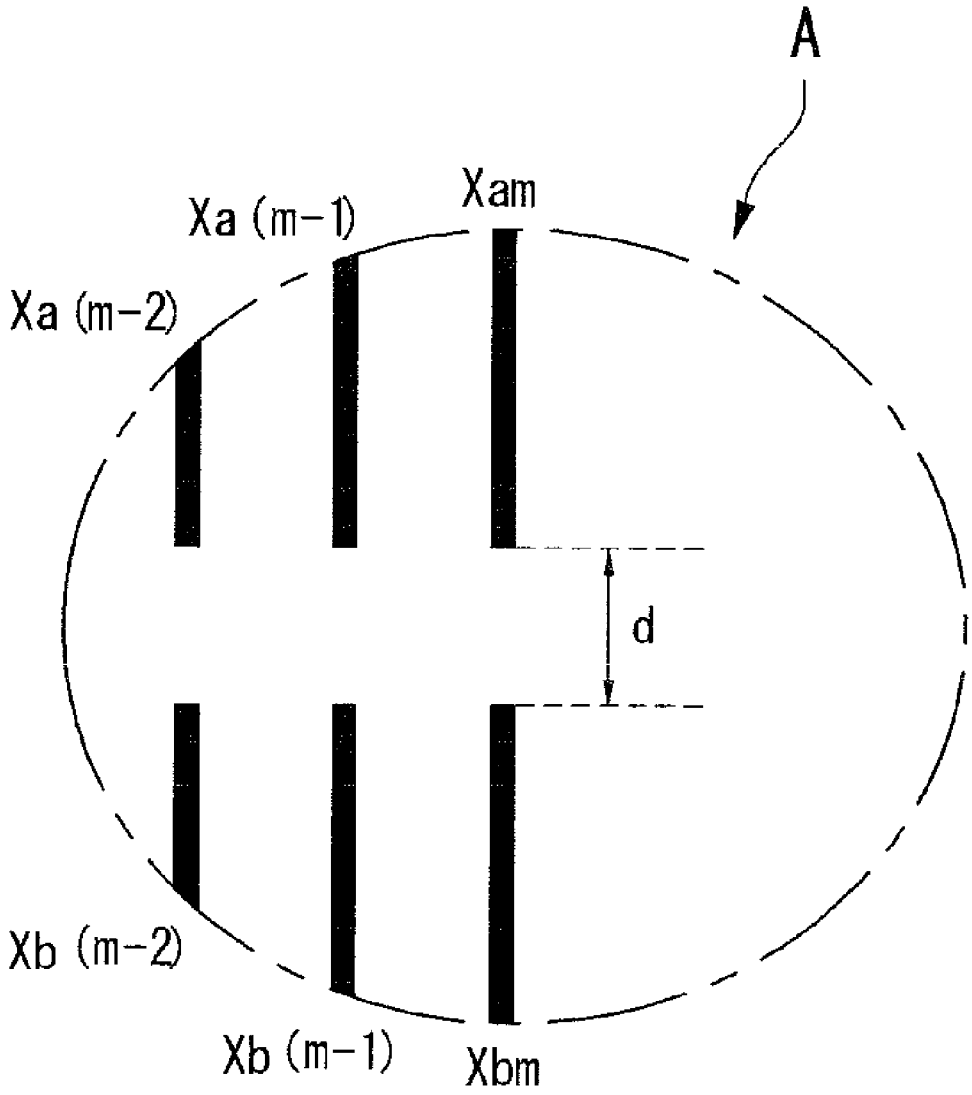

FIG. 1D shows in detail an area A where the first address electrodes and the second address electrodes are opposite to each other.

As shown in FIG. 1D, the first address electrodes Xa(m-2), Xa(m-1) and Xam are opposite to the second address electrodes Xb(m-2), Xb(m-1) and Xbm with a distance d therebetween, respectively.

When the distance d between the first address electrode and the second address electrode is excessively short, it is likely that a current flows due to a coupling effect between the first address electrode and the second address electrode. On the other hand, when the distance d is excessively long, a viewer may watch a striped noise on an image displayed on the plasma display panel.

Considering this, the distance d may lie in a range between about 50 μm and 300 μm. Further, the distance d may lie in a range between about 70 μm and 220 μm.

Figures 2, 3:
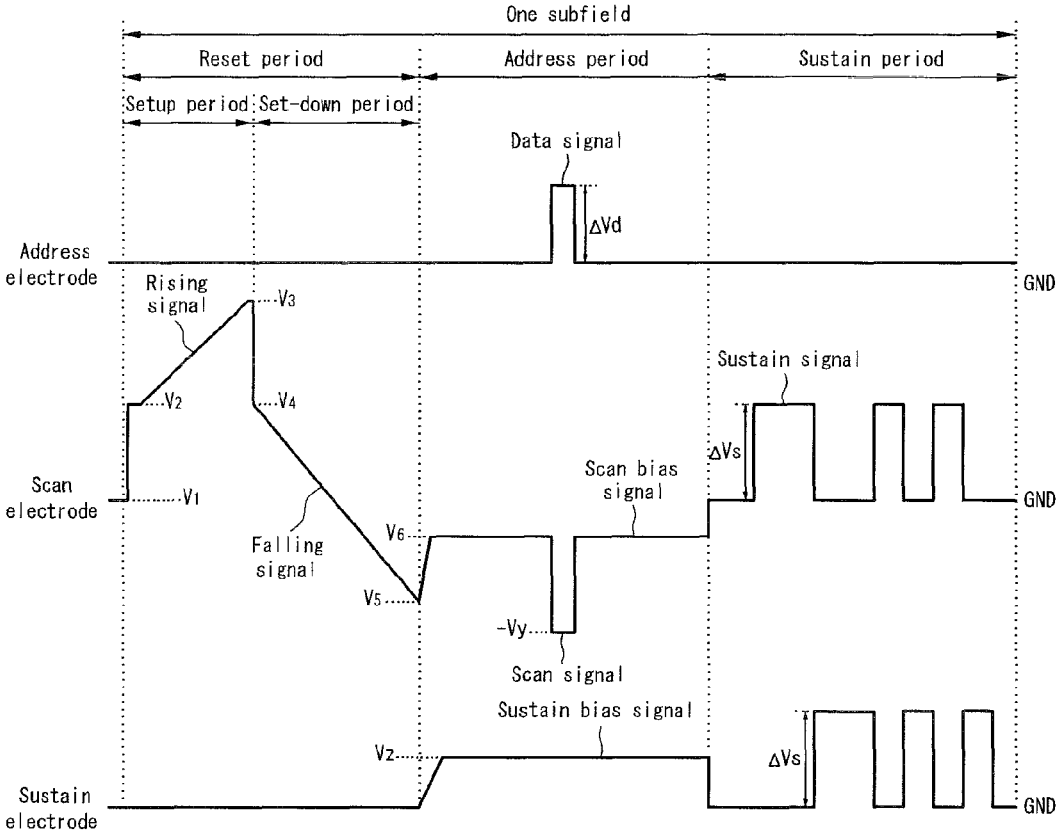
FIG. 2 illustrates an operation of the plasma display panel according to the exemplary embodiment.
FIG. 3 is a table showing a composition of a phosphor layer.

FIG. 2 illustrates an example of an operation of the plasma display panel according to the exemplary embodiment. The exemplary embodiment is not limited to the operation shown in FIG. 2, and a method for operating the plasma display panel may be variously changed.

As shown in FIG. 2, during a reset period for initialization of wall charges, a reset signal is supplied to the scan electrode.

The reset signal includes a rising signal and a falling signal. The reset period is further divided into a setup period and a set-down period.

During the setup period, the rising signal is supplied to the scan electrode. The rising signal sharply rises from a first voltage V1 to a second voltage V2, and then gradually rises from the second voltage V2 to a third voltage V3. The first voltage V1 may be a ground level voltage GND.

The rising signal generates a weak dark discharge (i.e., a setup discharge) inside the discharge cell during the setup period, thereby accumulating a proper amount of wall charges inside the discharge cell.

During the set-down period, a falling signal of a polarity opposite a polarity of the rising signal is supplied to the scan electrode. The falling signal gradually falls from a fourth voltage V4 lower than a peak voltage (i.e., the third voltage V3) of the rising signal to a fifth voltage V5.

The falling signal generates a weak erase discharge (i.e., a set-down discharge) inside the discharge cell. Furthermore, the remaining wall charges are uniform inside the discharge cells to the extent that an address discharge can be stably performed.

During an address period following the reset period, a scan bias signal, which is maintained at a sixth voltage V6 higher than a lowest voltage (i.e., the fifth voltage V5) of the falling signal, is supplied to the scan electrode. A scan signal, which falls from the scan bias signal to a scan voltage −Vy, is supplied to the scan electrode.

A width of a scan signal supplied during an address period of at least one subfield may be different from a width of a scan signal supplied during address periods of the other subfields. For instance, a width of a scan signal in a subfield may be larger than a width of a scan signal in the next subfield in time order. Further, a width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, . . . , 1.9 μS, 1.9 μS, etc.

As above, when the scan signal is supplied to the scan electrode, a data signal corresponding to the scan signal is supplied to the address electrode. The data signal rises from a ground level voltage GND by a data voltage magnitude ΔVd.

As the voltage difference between the scan signal and the data signal is added to the wall voltage generated during the reset period, the address discharge occurs within the discharge cell to which the data signal is supplied.

A sustain bias signal is supplied to the sustain electrode during the address period to prevent the address discharge from unstably occurring by interference of the sustain electrode Z.

The sustain bias signal is substantially maintained at a sustain bias voltage Vz. The sustain bias voltage Vz is lower than a voltage Vs of a sustain signal and is higher than the ground level voltage GND.

During a sustain period following the address period, a sustain signal is alternately supplied to the scan electrode and the sustain electrode. The sustain signal has a voltage magnitude corresponding to the sustain voltage Vs.

As the wall voltage within the discharge cell selected by performing the address discharge is added to the sustain voltage Vs of the sustain signal, every time the sustain signal is supplied, the sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can be more stable.

FIG. 3 is a table showing a composition of a phosphor layer.

As shown in FIG. 3, a first phosphor layer emitting red light includes a first phosphor material having a white-based color and a red pigment.

The first phosphor material is not particularly limited except the red light emission. The first phosphor material may be (Y, Gd)BO:Eu in consideration of an emitting efficiency of red light.

The red pigment has a red-based color. The first phosphor layer may have a red-based color by mixing the red pigment with the first phosphor material. The red pigment is not particularly limited except the red-based color. The red pigment may include an iron (Fe)-based material in consideration of facility of powder manufacture, color, and manufacturing cost.

The Fe-based material may exist in a state of iron oxide in the first phosphor layer. For instance, the Fe-based material may exist in a state of $\alpha Fe_2O_3$ in the first phosphor layer.

As above, when the first phosphor layer includes the red pigment, the red pigment absorbs light coming from the outside. Hence, a reflectance of the plasma display panel can be reduced and a contrast characteristic can be improved.

To further improve the contrast characteristic, a second phosphor layer emitting blue light includes a second phosphor material having a white-based color and a blue pigment.

The second phosphor material is not particularly limited except the blue light emission. The second phosphor material may be (Ba, Sr, Eu)$MgAl_{10}O_{17}$ in consideration of an emitting efficiency of blue light.

The blue pigment has a blue-based color. The second phosphor layer may have a blue-based color by mixing the blue pigment with the second phosphor material. The blue pigment is not particularly limited except the blue-based color. The blue pigment may include at least one of a cobalt (Co)-based material, a copper (Cu)-based material, a chrome (Cr)-based material or a nickel (Ni)-based material in consideration of facility of powder manufacture, color, and manufacturing cost.

At least one of the Co-based material, the Cu-based material, the Cr-based material or the Ni-based material may exist in a state of metal oxide in the second phosphor layer. For instance, the Co-based material may exist in a state of $CoAl_2O_4$ in the second phosphor layer.

A third phosphor layer emitting green light includes a third phosphor material having a white-based color, and may not include a pigment.

The third phosphor material is not particularly limited except the green light emission. The third phosphor material may include $Zn_2SiO_4:Mn^{+2}$ and $YbO_3:Tb^{+3}$ in consideration of an emitting efficiency of green light.

Figure 4A:
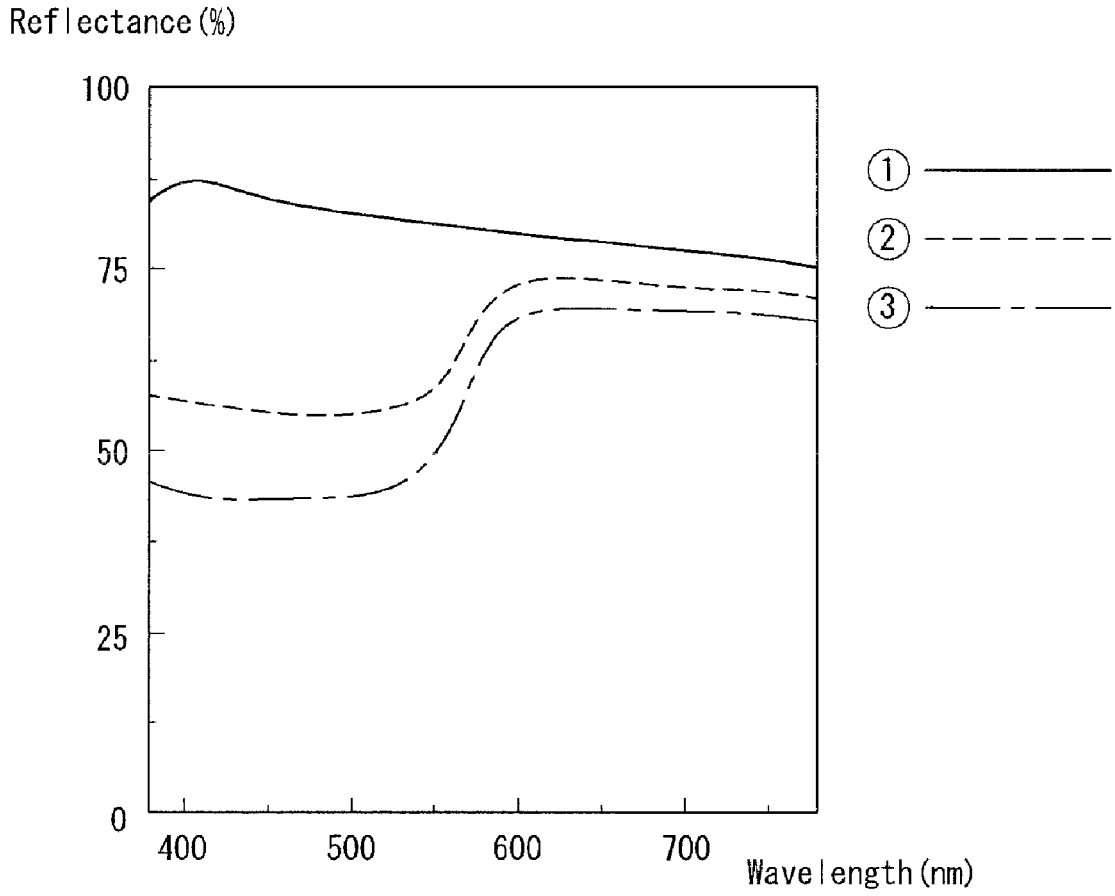
FIGS. 4A and 4B are graphs showing reflectances depending on compositions of first and second phosphor layers, respectively.
Figure 4B:
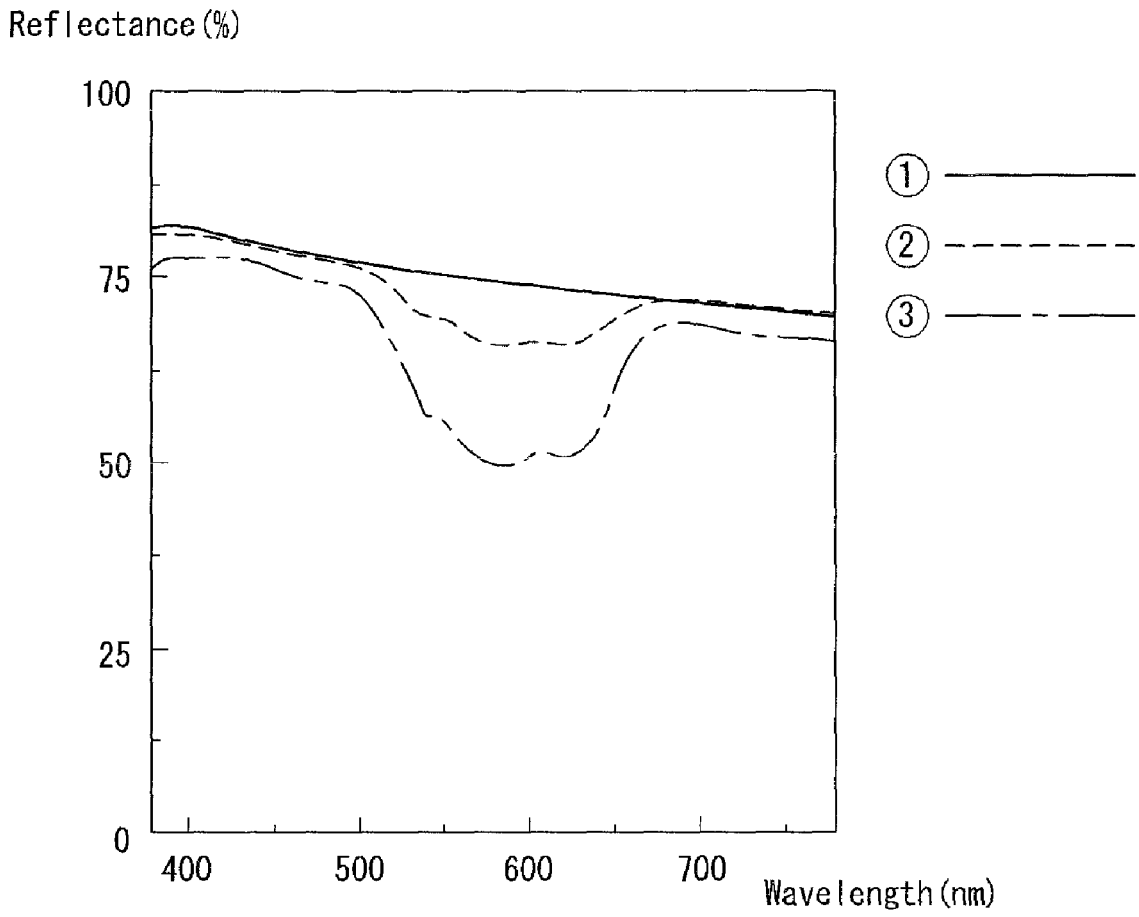

FIGS. 4A and 4B are graphs showing reflectances depending on compositions of first and second phosphor layers, respectively.

First, a 7-inch test model on which a first phosphor layer emitting red light from all discharge cells is formed is manufactured. Then, light is directly irradiated on a barrier rib and the first phosphor layer of the test model in a state where a front substrate of the test model is removed to measure a reflectance of the test model.

The first phosphor layer includes a first phosphor material and a red pigment. The first phosphor material is (Y, Gd)BO:Eu. The red pigment is an Fe-based material, and the Fe-based material in a state of $\alpha Fe_2O_3$ is mixed with the first phosphor material.

In FIG. 4A, ① indicates a case where the first phosphor layer does not include the red pigment. ② indicates a case where the first phosphor layer includes the red pigment of 0.1 part by weight. ③ indicates a case where the first phosphor layer includes the red pigment of 0.5 part by weight.

In case of ① not including the red pigment, a reflectance is equal to or more than about 75% at a wavelength of 400 nm to 750 nm. Because the first phosphor material having a white-based color reflects most of incident light, the reflectance in ① is high.

In case of ② including the red pigment of 0.1 part by weight, a reflectance is equal to or less than about 60% at a wavelength of 400 nm to 550 nm ranges from about 60% to 75% at a wavelength more than 550 nm.

In case of ③ including the red pigment of 0.5 part by weight, a reflectance is equal to or less than about 50% at a wavelength of 400 nm to 550 nm and ranges from about 50% to 70% at a wavelength more than 550 nm.

Because the red pigment having a red-based color absorbs incident light, the reflectances in ② and ③ are less than the reflectance in ①.

FIG. 4B is a graph showing a reflectance of a test module depending on a wavelength. First, a 7-inch test model on which a second phosphor layer emitting blue light from all discharge cells is formed is manufactured. Then, light is directly irradiated on a barrier rib and the second phosphor layer of the test model in a state where a front substrate of the test model is removed to measure a reflectance of the test model.

The second phosphor layer includes a second phosphor material and a blue pigment. The second phosphor material is (Ba, Sr, Eu)$MgAl_{10}O_{17}$. The blue pigment is a Co-based material, and the Co-based material in a state of $CoAl_2O_4$ is mixed with the second phosphor material.

In FIG. 4B, ① indicates a case where the second phosphor layer does not include the blue pigment. ② indicates a case where the second phosphor layer includes the blue pigment of 0.1 part by weight. ③ indicates a case where the second phosphor layer includes the blue pigment of 1.0 part by weight.

In case of ① not including the blue pigment, a reflectance is equal to or more than about 72% at a wavelength of 400 nm to 750 nm. Because the second phosphor material having a white-based color reflects most of incident light, the reflectance in ① is high.

In case of ② including the blue pigment of 0.1 part by weight, a reflectance is equal to or more than about 74% at a wavelength of 400 nm to 510 nm, falls to about 60% at a wavelength of 510 nm to 650 nm, and rises to about 72% at a wavelength more than 650 nm.

In case of ③ including the blue pigment of 1.0 part by weight, a reflectance is at least 50% at a wavelength of 510 nm to 650 nm.

Because the blue pigment having a blue-based color absorbs incident light, the reflectances in ② and ③ are less than the reflectance in ①. A reduction in the reflectance can improve the contrast characteristic, and thus the image quality can be improved.

As described above, in case the first phosphor layer includes the red pigment, the red screen may be seen by the red pigment. Hence, a color temperature of an image displayed on the red screen may be reduced. Further, the viewer may easily feel eyestrain and may feel that the image is not clear.

Even if the second phosphor layer includes the blue pigment, it is difficult to sufficiently prevent a reduction in the color temperature because a luminance of blue light generated by the second phosphor material is smaller than a luminance of red light generated by the first phosphor material.

Accordingly, the plasma display panel according to the exemplary embodiment allows a thickness of the second phosphor layer to be larger than a thickness of the first phosphor layer, and thus can prevent a reduction in the color temperature caused by the red pigment.

Figure 5:
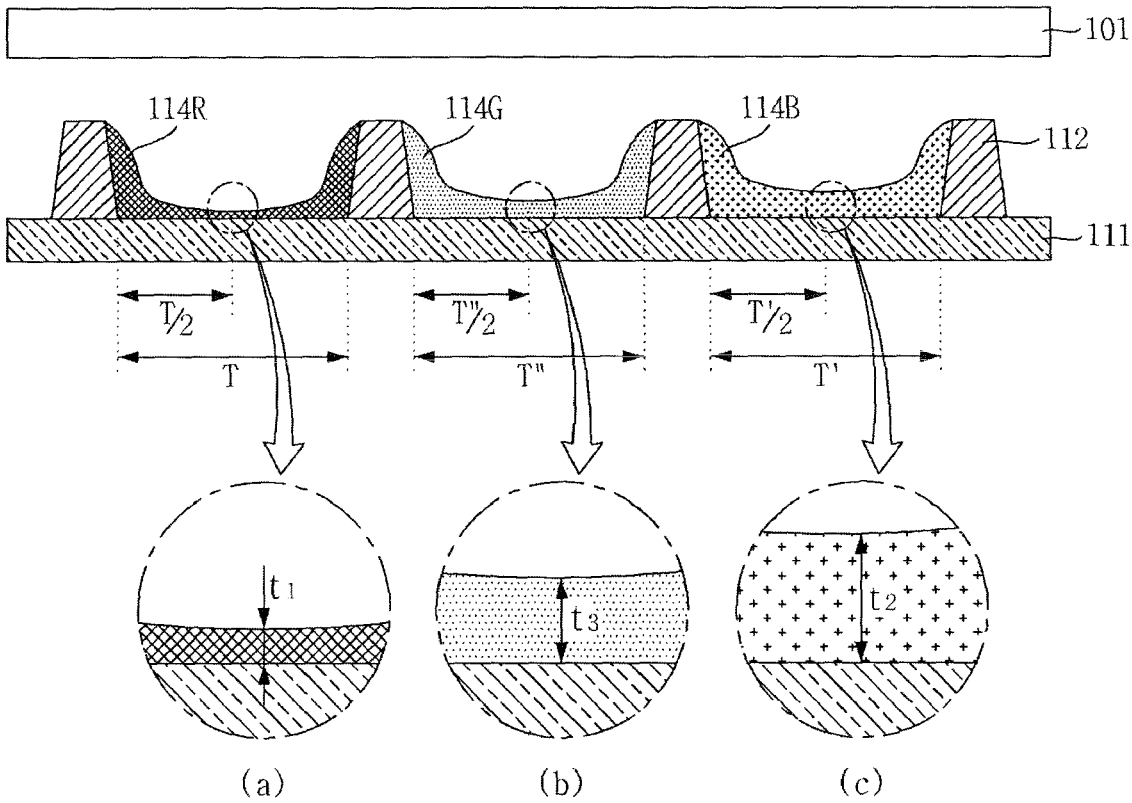
FIG. 5 shows a thickness of a phosphor layer.

FIG. 5 shows a thickness of a phosphor layer.

As shown in FIG. 5, a thickness t2 of a second phosphor layer 114B formed inside a second discharge cell in (c) is larger than a thickness t1 of a first phosphor layer 114R formed inside a first discharge cell in (a) A thickness t3 of a third phosphor layer 114G formed inside a third discharge cell in (b) may be equal to or different from the thickness t1 of the first phosphor layer 114R.

When a width of the first discharge cell in a direction parallel to the scan electrode or the sustain electrode is indicated as T, the thickness t1 of the first phosphor layer 114R is a thickness measured at T/2.

When a width of the second discharge cell in a direction parallel to the scan electrode or the sustain electrode is indicated as T', the thickness t2 of the second phosphor layer 114B is a thickness measured at T'/2.

The fact that the thickness t2 of the second phosphor layer 114B is larger than the thickness t1 of the first phosphor layer 114R means that the amount of second phosphor material coated inside the second discharge cell is more than the amount of first phosphor material coated inside the first discharge cell. Hence, because the amount of blue light emitted from the second discharge cell increases, a color temperature of a displayed image can be improved.

Figure 6:
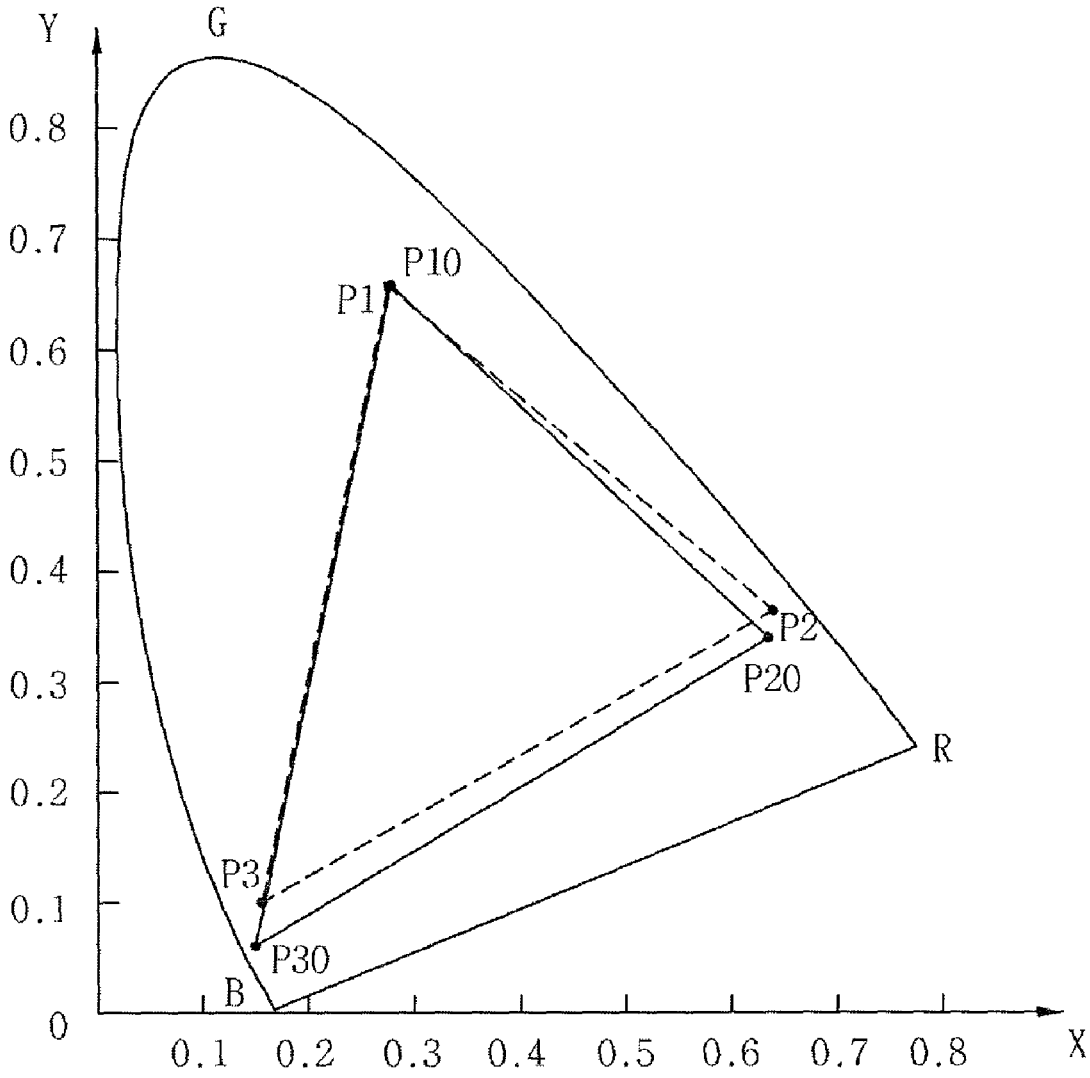
FIG. 6 is a graph showing color coordinates of a plasma display panel depending on changes in a width of a discharge cell.

FIG. 6 is a graph measuring color coordinates of an A-type panel and a B-type panel. In the A-type panel, a first phosphor layer includes a red pigment of 0.2 part by weight, a second phosphor layer includes a blue pigment of 1.0 part by weight, a thickness of the second phosphor layer is 1.2 times larger than a thickness of the first phosphor layer, and a thickness of a third phosphor layer is substantially equal to the thickness of the first phosphor layer. In the B-type panel, a first phosphor layer includes a red pigment of 0.2 part by weight, a second phosphor layer includes a blue pigment of 1.0 part by weight, and thicknesses of the first, second and third phosphor layers are substantially equal to one another.

As shown in FIG. 6, in the B-type panel, a green coordinate P1 has X-axis coordinate of about 0.276 and Y-axis coordinate of about 0.653, a red coordinate P2 has X-axis coordinate of about 0.640 and Y-axis coordinate of about 0.365, and a blue coordinate P3 has X-axis coordinate of about 0.157 and Y-axis coordinate of about 0.100.

In the A-type panel, a green coordinate P10 has X-axis coordinate of about 0.278 and Y-axis coordinate of about 0.654, a red coordinate P20 has X-axis coordinate of about 0.636 and Y-axis coordinate of about 0.340, and a blue coordinate P30 has X-axis coordinate of about 0.140 and Y-axis coordinate of about 0.060.

It can be seen from FIG. 6 that a triangle connecting the three coordinates P10, P20 and P30 of the A-type panel further moves in a blue direction as compared with a triangle connecting the three coordinates P1, P2 and P3 of the B-type panel. This means that a color temperature of the A-type panel is higher than a color temperature of the B-type panel. Hence, the viewer may think that an image displayed on the A-type panel is clearer than an imaged displayed on the B-type panel.

Figure 7A:
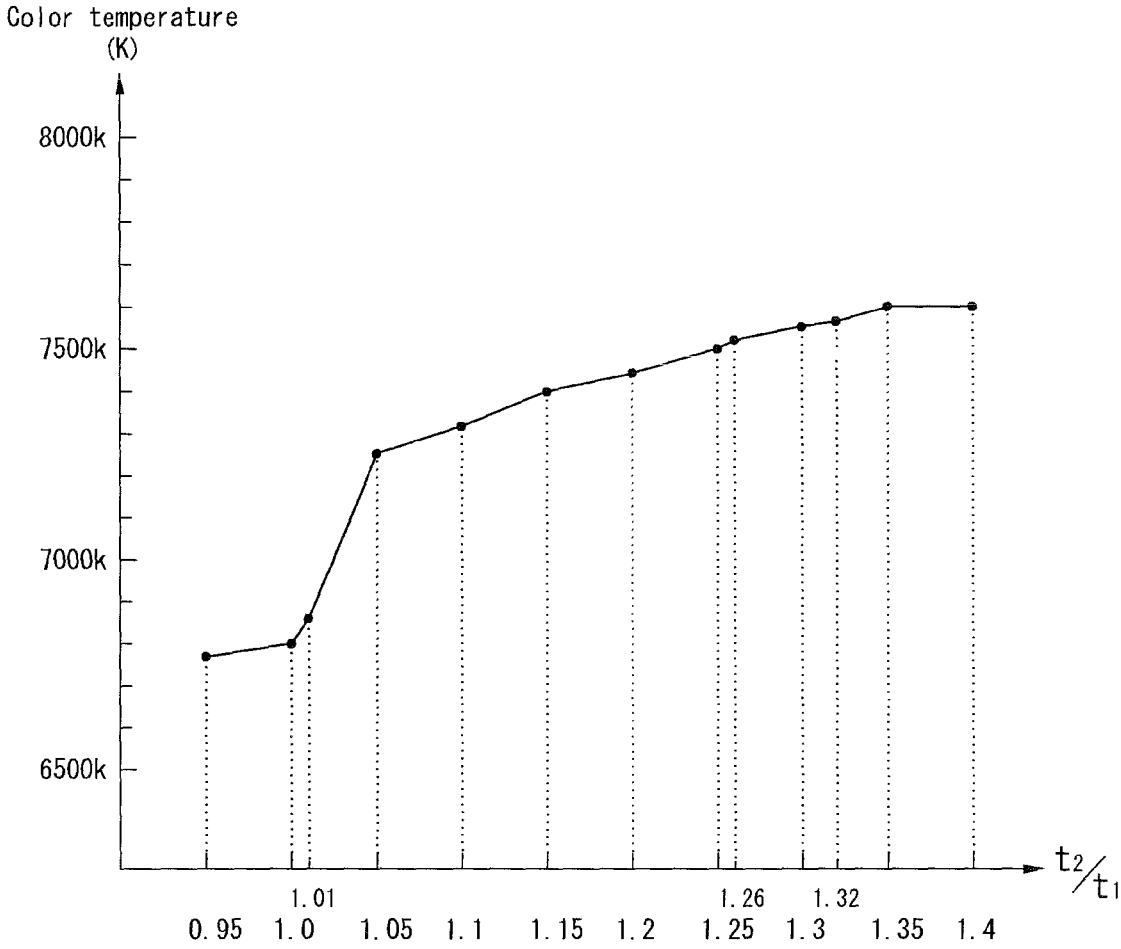

FIGS. 7A and 7B are a graph and a table showing a color temperature and a color representability depending on thicknesses of first and second phosphor layers, respectively.

FIG. 7A is a graph showing a color temperature of an image displayed when a ratio t2/t1 of a thickness t2 of the second phosphor layer to a thickness t1 of the first phosphor layer changes from 0.95 to 1.4. In FIG. 7A, the thickness t2 of the second phosphor layer changes in a state where the thickness t1 of the first phosphor layer is fixed to about 13 μm.

As shown in FIG. 7A, when the ratio t2/t1 ranges from 0.95 to 1.0, a color temperature of an image is a relatively small value of about 6770K to 6800K.

When the ratio t2/t1 is 1.01, a color temperature increases to about 6860K.

When the ratio t2/t1 is 1.05, a color temperature is about 7250K.

When the ratio t2/t1 ranges from 1.1 to 1.26, a color temperature is a relatively high value of about 7320K to 7520K.

When the ratio t2/t1 is equal to or more than 1.3, a color temperature is equal to or more than about 7550K.

As the ratio t2/t1 increases, the amount of blue light generated in the second discharge cell increases. Hence, the color temperature increases. On the other hand, when the ratio t2/t1 is equal to or more than 1.35, an increase width of the color temperature is small.

FIG. 7B is a table showing a color representability when a ratio t2/t1 of a thickness t2 of the second phosphor layer to a thickness t1 of the first phosphor layer changes from 0.95 to 1.4.

In FIG. 7B, ◎ indicates that the color representability is excellent, ○ indicates that the color representability is good, and X indicates that the color representability is bad.

As shown in FIG. 7B, when the ratio t2/t1 is 0.95, the color representability is good. When the ratio t2/t1 ranges from 1.30 to 1.32, the color representability is good.

When the ratio t2/t1 ranges from 1.0 to 1.26, the color representability is excellent. In this case, red and blue can be sufficiently clearly displayed on the screen.

When the ratio t2/t1 is equal to or more than 1.4, the red representability is reduced because the thickness t1 of the first phosphor layer is excessively smaller than the thickness t2 of the second phosphor layer. Hence, the color representability of the panel is bad.

Considering the description of FIGS. 7A and 7B, the thickness t2 of the second phosphor layer may be 1.01 to 1.32 times the thickness t1 of the first phosphor layer. The thickness t2 may be 1.05 to 1.26 times the thickness t1.

Figure 8A:
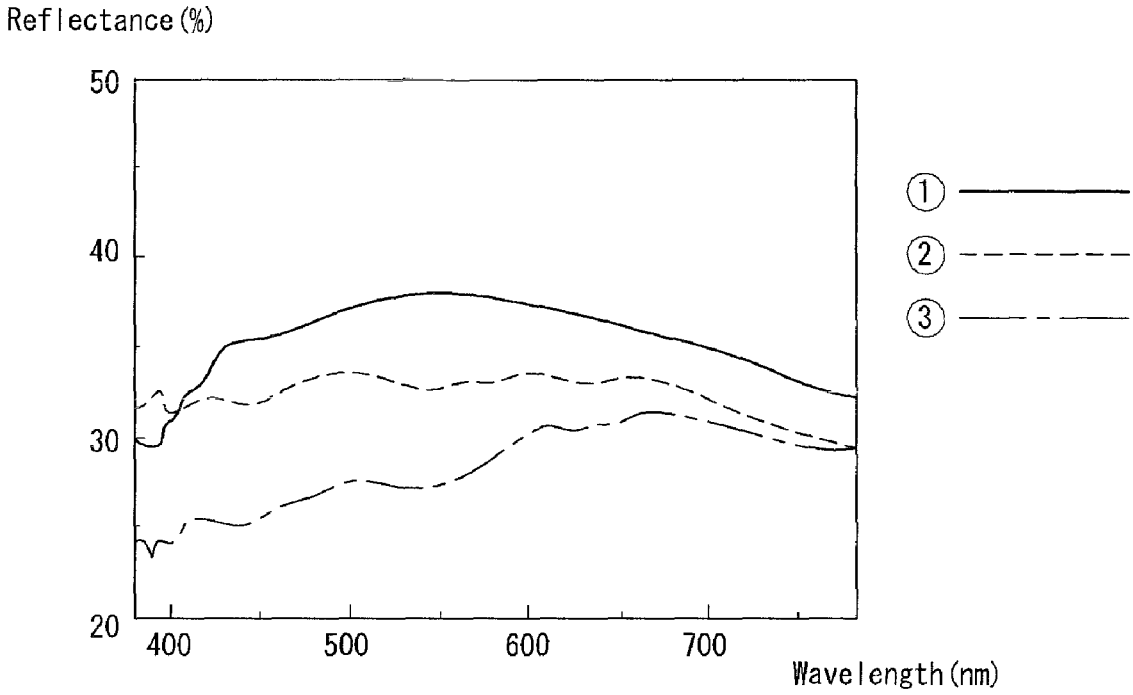
FIGS. 8A and 8B are graphs showing a reflectance and a luminance of a plasma display panel depending on changes in a content of a red pigment, respectively.
Figure 8B:
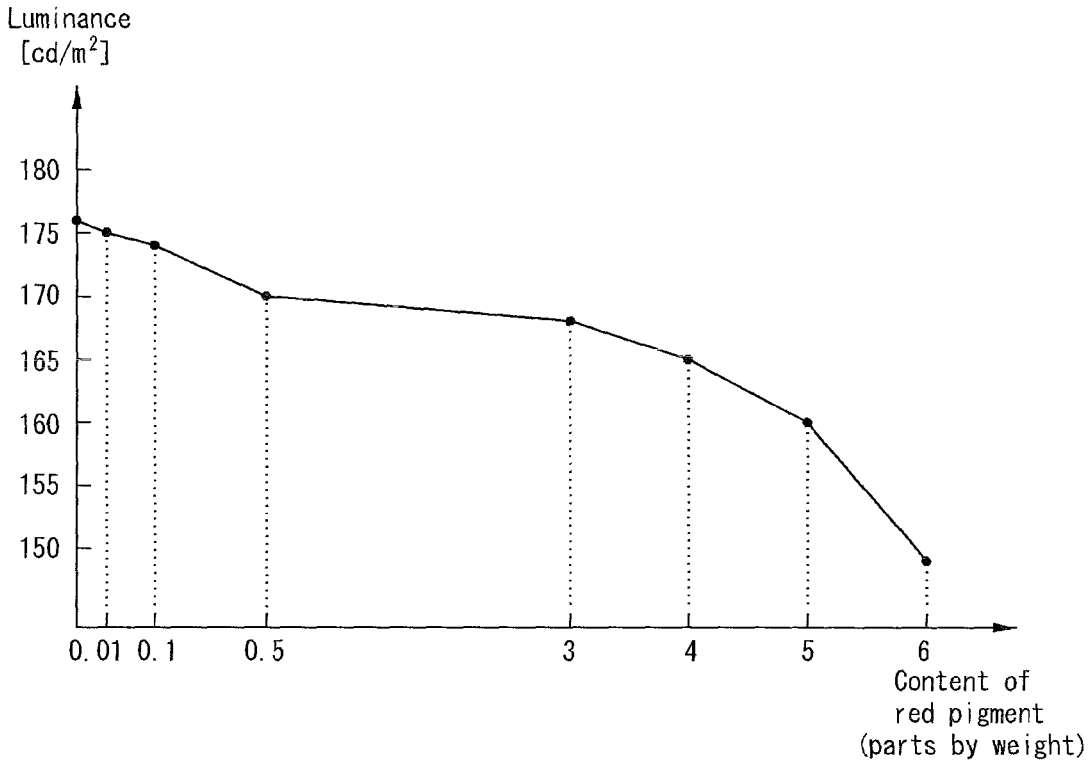

FIGS. 8A and 8B are graphs showing a reflectance and a luminance of a plasma display panel depending on changes in a content of a red pigment, respectively.

In FIGS. 8A and 8B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of the red pigment mixed with the first phosphor layer in a state where the blue pigment of 1.0 part by weight is mixed with the second phosphor layer. In this case, the reflectance and the luminance of the plasma display panel are measured in a panel state in which the front substrate and the rear substrate coalesce with each other.

The first phosphor material is (Y, Gd)BO:Eu. The red pigment is an Fe-based material, and the Fe-based material in a state of $\alpha Fe_2O_3$ is mixed with the first phosphor material.

The second phosphor material is $(Ba, Sr, Eu)MgAl_{10}O_{17}$. The blue pigment is a Co-based material, and the Co-based material in a state of $CoAl_2O_4$ is mixed with the second phosphor material.

In FIG. 8A, ① indicates a case where the first phosphor layer does not include the red pigment in a state where the second phosphor layer includes the blue pigment of 1.0 part by weight. ② indicates a case where the first phosphor layer includes the red pigment of 0.1 part by weight in a state where the second phosphor layer includes the blue pigment of 1.0 part by weight. ③ indicates a case where the first phosphor layer includes the red pigment of 0.5 part by weight in a state where the second phosphor layer includes the blue pigment of 1.0 part by weight.

In case of ① not including the red pigment, a panel reflectance rises from about 33% to 38% at a wavelength of 400 nm to 550 nm. The panel reflectance falls to about 33% at a wavelength more than 550 nm. In other words, the panel reflectance has a high value of about 37% to 38% at a wavelength of 500 nm to 600 nm.

Because the first phosphor material having a white-based color reflects most of incident light, the panel reflectance in ① is relatively high although the blue pigment is mixed with the second phosphor layer.

In case of ② including the red pigment of 0.1 part by weight, a panel reflectance is equal to or less than about 34% at a wavelength of 400 nm to 750 nm, and has a relatively small value of about 33% to 34% at a wavelength of 500 nm to 600 nm.

In case of ③ including the red pigment of 0.5 part by weight, a panel reflectance ranges from about 24% to 31.5% at a wavelength of 400 nm to 650 nm and falls to about 30% at a wavelength of 650 nm to 750 nm. Further, the panel reflectance has a relatively small value of about 27.5% to 29.5% at a wavelength of 500 nm to 600 nm.

As above, as a content of the red pigment increases, the panel reflectance decreases.

There is a relatively great difference between the panel reflectance in ① not including the red pigment and the panel reflectances in ② and ③ including the red pigment at a wavelength of 500 nm to 600 nm, for instance, at a wavelength of 550 nm.

Because a wavelength of 500 nm to 600 nm is mainly seen as red, orange and yellow light in visible light, the high panel reflectance at a wavelength of 500 nm to 600 nm means that a displayed image is close to red. In this case, because a color temperature is relatively low, the viewer may easily feel eyestrain and may feel that the image is not clear.

On the other hand, the low panel reflectance at a wavelength of 500 nm to 600 nm means that absorptance of red, orange and yellow light is high. Hence, a color temperature of a displayed image is relatively high, and thus an image can be clearer.

Accordingly, the relatively great difference between the panel reflectance in ① and the panel reflectance in ② and ③ at a wavelength of 500 nm to 600 nm means that an excessive reduction in the color temperature can be prevented although the red pigment is mixed with the first phosphor layer. Hence, the viewer can watch a clearer image.

Considering this, the color temperature of the panel can be improved by setting the panel reflectance to be equal to or less than 30% at a wavelength of 500 nm to 600 nm, for instance, at a wavelength of 550 nm.

FIG. 8B is a graph showing a luminance of the same image depending on changes in a content of the red pigment included in the first phosphor layer in a state where a content of the blue pigment included in the second phosphor layer is fixed.

As shown in FIG. 8B, a luminance of an image displayed when the first phosphor layer does not include the red pigment is about 176 cd/m$^2$.

When a content of the red pigment is 0.01 part by weight, the luminance of the image is reduced to about 175 cd/m$^2$. The red pigment can reduce the luminance of the image, because particles of the red pigment cover a portion of the particle surface of the first phosphor material and thus hinder ultraviolet rays generated by a discharge inside the discharge cell from being irradiated on the particles of the first phosphor material.

When a content of the red pigment ranges from 0.1 to 3 parts by weight, a luminance of the image ranges from about 168 cd/m$^2$ to 174 cd/m$^2$.

When a content of the red pigment ranges from 3 to 5 parts by weight, a luminance of the image ranges from about 160 cd/m$^2$ to 168 cd/m$^2$.

When a content of the red pigment is equal to or more than 6 parts by weight, a luminance of the image is sharply reduced to a value equal to or less than about 149 cd/m$^2$. In other words, when a large amount of the red pigment is mixed, the particles of the red pigment cover a large area of the particle surface of the first phosphor material and thus the luminance is sharply reduced.

Considering the graphs of FIGS. 8A and 8B, when a content of the red pigment ranges from 0.01 to 5 parts by weight, a reduction in the luminance can be prevented while the panel reflectance is reduced. A content of the red pigment may range from 0.1 to 3 parts by weight.

Figure 9A:
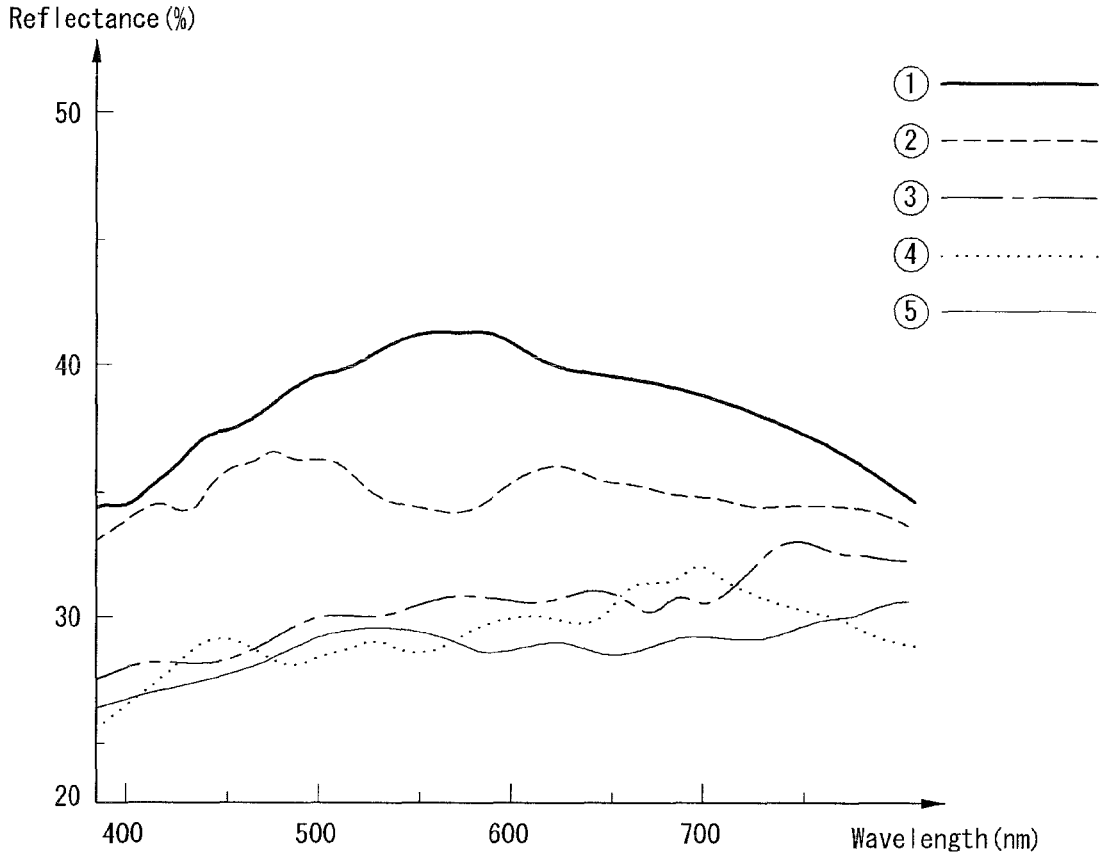
FIGS. 9A and 9B are graphs showing a reflectance and a luminance of a plasma display panel depending on changes in a content of a blue pigment, respectively.
Figure 9B:
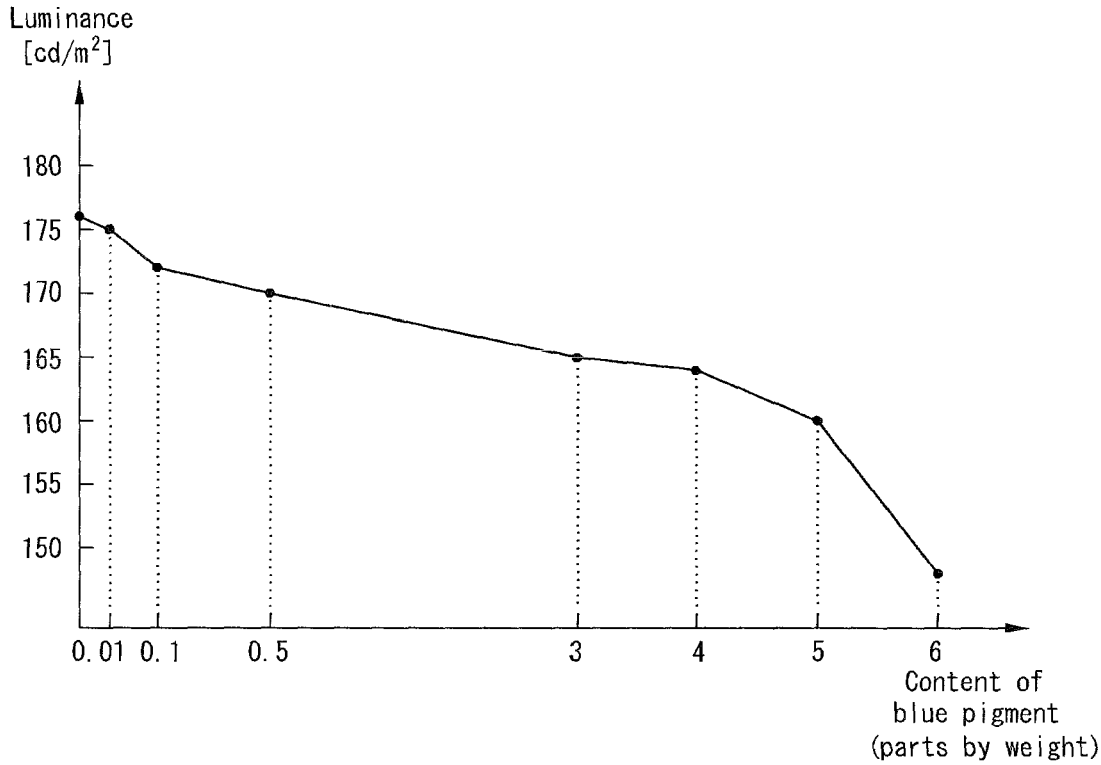

FIGS. 9A and 9B are graphs showing a reflectance and a luminance of a plasma display panel depending on changes in a content of a blue pigment, respectively. A description of FIGS. 9A and 9B overlapping the description of FIGS. 8A and 8B is briefly made or entirely omitted.

In FIGS. 9A and 9B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of the blue pigment mixed with the second phosphor layer in a state where the red pigment of 0.2 part by weight is mixed with the first phosphor layer. In this case, the reflectance and the luminance of the plasma display panel are measured in a panel state in which the front substrate and the rear substrate coalesce with each other.

The other experimental conditions in FIGS. 9A and 9B are substantially the same as the experimental conditions in FIGS. 8A and 8B.

In FIG. 9A, ① indicates a case where the second phosphor layer does not include the blue pigment in a state where the first phosphor layer includes the red pigment of 0.2 part by weight. ② indicates a case where the second phosphor layer includes the blue pigment of 0.1 part by weight in a state where the first phosphor layer includes the red pigment of 0.2 part by weight. ③ indicates a case where the second phosphor layer includes the blue pigment of 0.5 part by weight in a state where the first phosphor layer includes the red pigment of 0.2 part by weight. ④ indicates a case where the second phosphor layer includes the blue pigment of 3 parts by weight in a state where the first phosphor layer includes the red pigment of 0.2 part by weight. ⑤ indicates a case where the second phosphor layer includes the blue pigment of 7 parts by weight in a state where the first phosphor layer includes the red pigment of 0.2 part by weight.

In case of ① not including the blue pigment, a panel reflectance rises from about 35% to 40.5% at a wavelength of 400 nm to 550 nm. The panel reflectance falls to about 35.5% at a wavelength more than 550 nm. In other words, the panel reflectance has a high value of about 39% to 40.5% at a wavelength of 500 nm to 600 nm.

Because the second phosphor material having a white-based color reflects most of incident light, the panel reflectance in ① is relatively high although the red pigment is mixed with the first phosphor layer.

In case of ② including the blue pigment of 0.1 part by weight, a panel reflectance is equal to or less than about 38% at a wavelength of 400 nm to 750 nm, and has a relatively small value of about 34% to 37% at a wavelength of 500 nm to 600 nm.

In case of ③ including the blue pigment of 0.5 part by weight, a panel reflectance ranges from about 26% to 29% at a wavelength of 400 nm to 650 nm and falls from about 28% to 32.5% at a wavelength of 650 nm to 750 nm. Further, the panel reflectance has a relatively small value of about 28% to 29% at a wavelength of 500 nm to 600 nm.

In case of ④ including the blue pigment of 3 parts by weight, a panel reflectance ranges from about 22.5% to 29% at a wavelength of 400 nm to 650 nm and ranges from about 29% to 31% at a wavelength of 650 nm to 750 nm. Further, the panel reflectance has a relatively small value of about 26.5% to 28% at a wavelength of 500 nm to 600 nm.

In case of ⑤ including the blue pigment of 7 parts by weight, a panel reflectance ranges from about 25% to 28% at a wavelength of 400 nm to 700 nm and ranges from about 28% to 30% at a wavelength more than 700 nm.

As shown in FIG. 9B, a luminance of an image displayed when the second phosphor layer does not include the blue pigment is about 176 cd/m$^2$.

When a content of the blue pigment is 0.01 part by weight, a luminance of the image is about 175 cd/m$^2$.

When a content of the blue pigment is 0.1 part by weight, a luminance of the image is about 172 cd/m$^2$.

When a content of the blue pigment ranges from 0.5 to 4 parts by weight, a luminance of the image has a stable value of about 164 cd/m$^2$ to 170 cd/m$^2$. When a content of the blue pigment ranges from 4 to 5 parts by weight, a luminance of the image ranges from about 160 cd/m$^2$ to 164 cd/m$^2$.

When a content of the blue pigment exceeds 6 parts by weight, a luminance of the image is sharply reduced to a value equal to or less than about 148 cd/m$^2$. In other words, when a large amount of the blue pigment is mixed, particles of the blue pigment cover a large area of the particle surface of the second phosphor material, and thus the luminance is sharply reduced.

Considering the graphs of FIGS. 9A and 9B, when a content of the blue pigment ranges from 0.01 to 5 parts by weight, a reduction in the luminance can be prevented while the panel reflectance is reduced. A content of the blue pigment may range from 0.5 to 4 parts by weight.

A method of manufacturing the first phosphor layer will be described below as an example of a method of manufacturing the phosphor layer.

First, a powder of the first phosphor material including (Y, Gd)BO:Eu and a powder of the red pigment including $\alpha Fe_2O_3$ are mixed with a binder and a solvent to form a phosphor paste. In this case, the red pigment of a state mixed with gelatin may be mixed with the binder and the solvent. A viscosity of the phosphor paste may range from about 1,500 CP to 30,000 CP. An additive such as surfactant, silica, dispersion stabilizer may be added to the phosphor paste, as necessary needed.

The binder used may be ethyl cellulose-based or acrylic resin-based binder or polymer-based binder such as PMA or PVA. However, the binder is not particularly limited thereto. The solvent used may use α-tei-pineol, butyl carbitol, diethylene glycol, methyl ether, and so forth. However, the solvent is not particularly limited thereto.

The phosphor paste is coated inside the discharge cells partitioned by the barrier ribs. Then, a drying or firing process is performed on the coated phosphor paste to form the first phosphor layer.

Figures 10A, 10B:
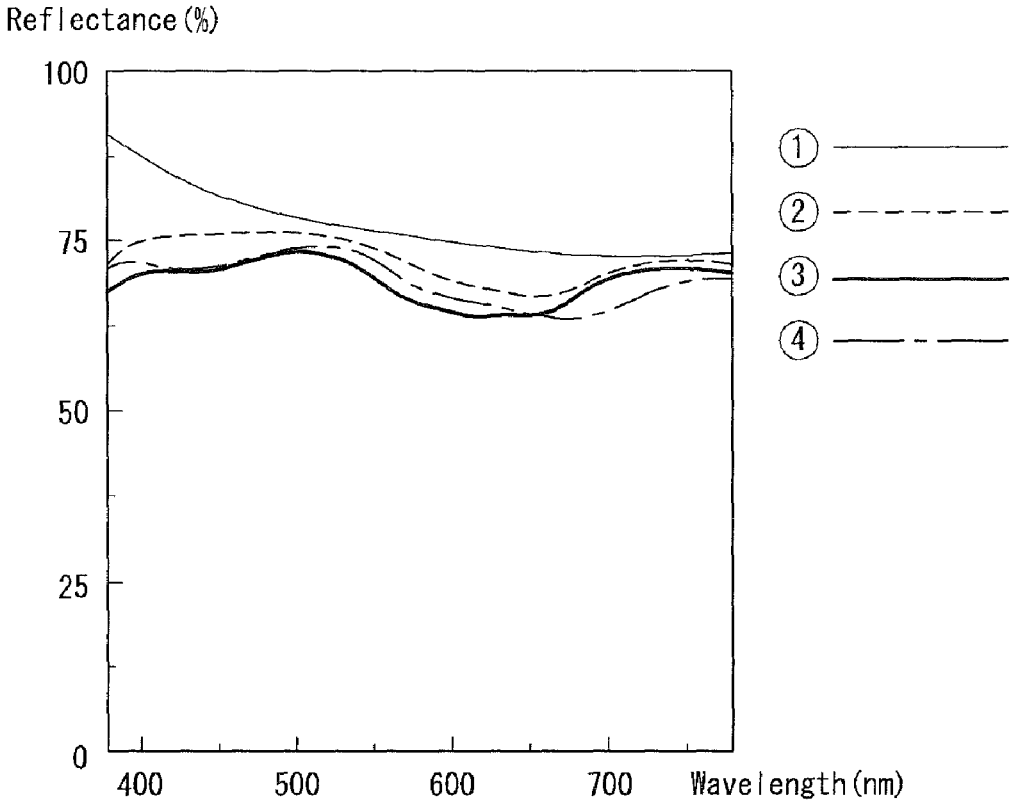
FIGS. 10A and 10B illustrate another example of a composition of a phosphor layer.

FIGS. 10A and 10B illustrate another example of a composition of a phosphor layer. A description in FIGS. 10A and 10B overlapping the description in FIG. 3 is briefly made or entirely omitted.

As shown in FIG. 10A, the third phosphor layer emitting green light includes a third phosphor material having a white-based color and a green pigment.

A description in FIG. 10A may be substantially the same as the description in FIG. 3 except that the third phosphor layer includes the green pigment.

The green pigment has a green-based color. The third phosphor layer may have a green-based color by mixing the green pigment with the third phosphor material. The green pigment is not particularly limited except the green-based color. The green pigment may include a zinc (Zn) material in consideration of facility of powder manufacture, color, and manufacturing cost.

The Zn-based material may exist in a state of zinc oxide, for instance, in a state of $ZnCO_2O_4$ in the third phosphor layer.

FIG. 10B is a graph showing a reflectance of a test model depending on a wavelength.

Similar to FIGS. 4A and 4B, a 7-inch test model on which a third phosphor layer emitting green light from all discharge cells is formed is manufactured. Then, light is directly irradiated on a barrier rib and the third phosphor layer of the test model in a state where a front substrate of the test model is removed to measure a reflectance of the test model.

The third phosphor layer includes a third phosphor material and a green pigment. The third phosphor material includes $Zn_2SiO_4$:$Mn^{+2}$ and $YBO_3$:$Tb^{+3}$ in a ratio of 5:5. The green pigment is a Zn-based material, and the Zn-based material in a state of $ZnCO_2O_4$ is mixed with the third phosphor material.

In FIG. 10B, ① indicates a case where the third phosphor layer does not include the green pigment. ② indicates a case where the third phosphor layer includes the green pigment of 0.1 part by weight. ③ indicates a case where the third phosphor layer includes the green pigment of 0.5 part by weight. ④ indicates a case where the third phosphor layer includes the green pigment of 1.0 part by weight.

In case of ① not including the green pigment, a reflectance is equal to or more than about 75% at a wavelength of 400 nm to 750 nm and is equal to or more than about 80% at a wavelength of 400 nm to 500 nm.

Because the third phosphor material having a white-based color reflects most of incident light, the reflectance in ① is high.

In case of ② including the green pigment of 0.1 part by weight, a reflectance is equal to or less than about 75% at a wavelength of 400 nm to 550 nm and ranges from about 66% to 70% at a wavelength of 550 nm to 700 nm.

In case of ③ including the green pigment of 0.5 part by weight, a reflectance is equal to or less than about 73% at a wavelength of 400 nm to 550 nm and ranges from about 63% to 65% at a wavelength more than 550 nm.

In case of ④ including the green pigment of 1.0 part by weight, a reflectance is similar to the reflectance in ③ at a wavelength of 400 cm to 750 nm.

Because the green pigment having a green-based color absorbs incident light, the reflectances in ②, ③ and ④ are less than the reflectance in ①.

The fact that the reflectances in ③ and ④ are similar to each other means that a reduction width of the panel reflectance is small although a content of the green pigment increases.

Figure 11B:
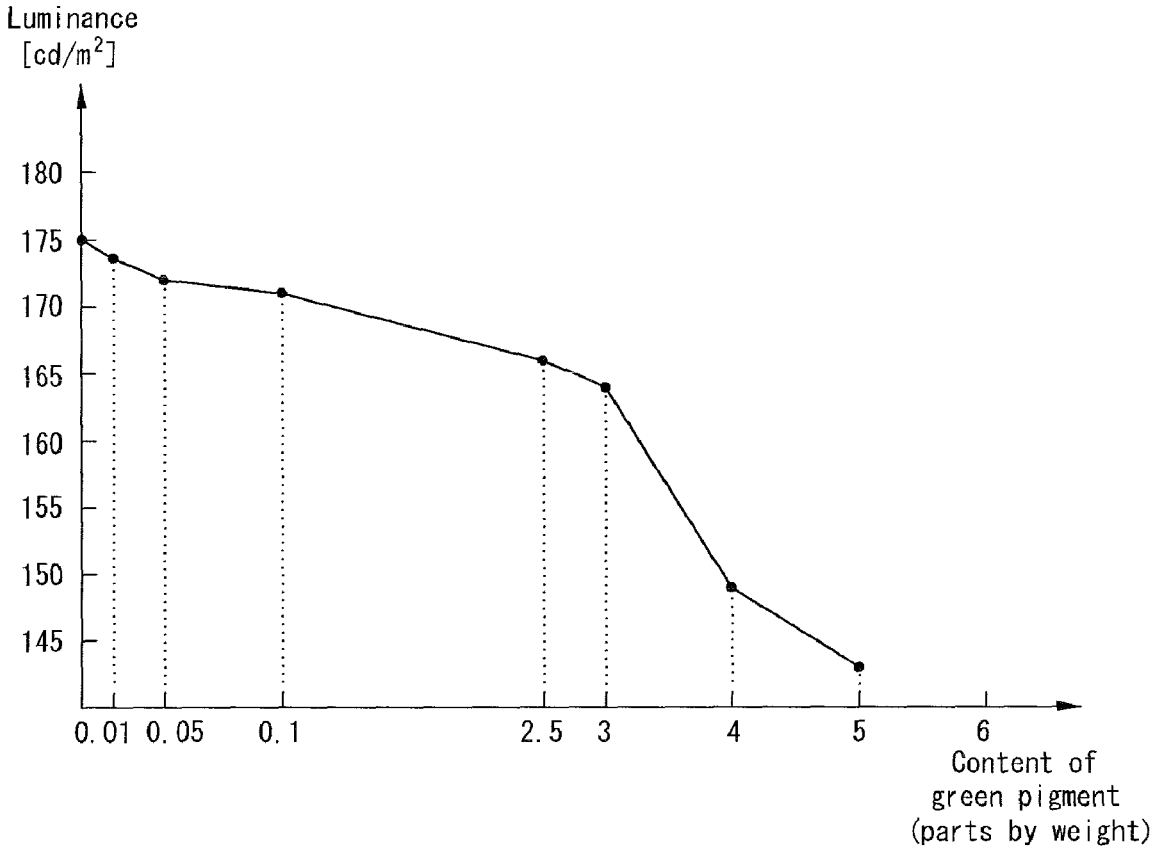

FIGS. 11A and 11B are a table and a graph showing a reflectance and a luminance of a plasma display panel depending on changes in a content of a green pigment, respectively.

In FIGS. 11A and 11B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of the green pigment mixed with the third phosphor layer in a state where the blue pigment of 1.0 part by weight is mixed with the second phosphor layer and the red pigment of 0.2 part by weight is mixed with the first phosphor layer. In this case, the reflectance and the luminance of the plasma display panel are measured in a panel state in which the front substrate and the rear substrate coalesce with each other.

The first phosphor material is (Y, Gd)BO:Eu. The red pigment is an Fe-based material, and the Fe-based material in a state of $\alpha Fe_2O_3$ is mixed with the first phosphor material.

The second phosphor material is (Ba, Sr, Eu)$MgAl_{10}O_{17}$. The blue pigment is a Co-based material, and the Co-based material in a state of $CoAl_2O_4$ is mixed with the second phosphor material.

The third phosphor material includes $Zn_2SiO_4$:$Mn^{+2}$ and $YBO_3$:$Tb^{+3}$ in a ratio of 5:5. The green pigment is a Zn-based material, and the Zn-based material in a state of $ZnCO_2O_4$ is mixed with the third phosphor material.

FIG. 11A is a table showing a reflectance at a wavelength of 550 nm.

As shown in FIG. 11A, when a content of the green pigment is 0, a panel reflectance is a relatively high value of 28%.

When a content of the green pigment is 0.01 part by weight, a panel reflectance is about 26.5%. When a content of the green pigment is 0.05 part by weight, a panel reflectance is about 26.2%.

When a content of the green pigment is 0.1 part by weight, a panel reflectance is about 26%. When a content of the green pigment is 0.2 part by weight, a parcel reflectance is about 25.9%.

When a content of the green pigment greatly increases to 2.5 parts by weight, a panel reflectance falls to about 24.3%.

When a content of the green pigment is 3 parts by weight, a panel reflectance is about 24%.

When a content of the green pigment is 4, 5 and 7 parts by weight, respectively, a panel reflectance is about 23.8%, 23.5% and 22.8%, respectively.

As can be seen from FIG. 11A, when a content of the green pigment is equal to or more than 4 parts by weight, a reduction width of the panel reflectance is small.

FIG. 11B is a graph showing a luminance of the same image depending on changes in a content of the green pigment included in the third phosphor layer in a state where a content of each of the red pigment and the blue pigment is fixed.

As shown in FIG. 11B, a luminance of an image displayed when the third phosphor layer does not include the green pigment is about 175 cd/$m^2$.

When a content of the green pigment is 0.01 part by weight, a luminance of the image is reduced to about 174 cd/$m^2$. The green pigment can reduce the luminance of the image, because particles of the green pigment cover a portion of the particle surface of the third phosphor material, and thus hinder ultraviolet rays generated by a discharge inside the discharge cell from being irradiated on the particles of the third phosphor material.

When a content of the green pigment ranges from 0.05 to 2.5 parts by weight, a luminance of the image has a stable value of about 166 cd/m$^2$ to 172 cd/m$^2$.

When a content of the green pigment is 3 parts by weight, a luminance of the image is about 164 cd/m$^2$.

When a content of the green pigment is equal to or more than 4 parts by weight, a luminance of the image is sharply reduced to a value equal to or less than about 149 cd/m$^2$. In other words, when a large amount of the green pigment is mixed, the particles of the green pigment cover a large area of the particle surface of the third phosphor material and thus the luminance is sharply reduced.

Considering FIGS. 11A and 11B, when a content of the green pigment ranges from 0.01 to 3 parts by weight, a reduction in the luminance can be prevented while the panel reflectance is reduced. A content of the green pigment may range from 0.05 to 2.5 parts by weight.

A reduction width in the panel reflectance when a content of the green pigment increases is smaller than a reduction width in the panel reflectance when the red pigment and the blue pigment are mixed. Accordingly, a content of the green pigment may be smaller than a content of each of the red pigment and the blue pigment. Further, the green pigment may not be mixed.

Figure 12A:
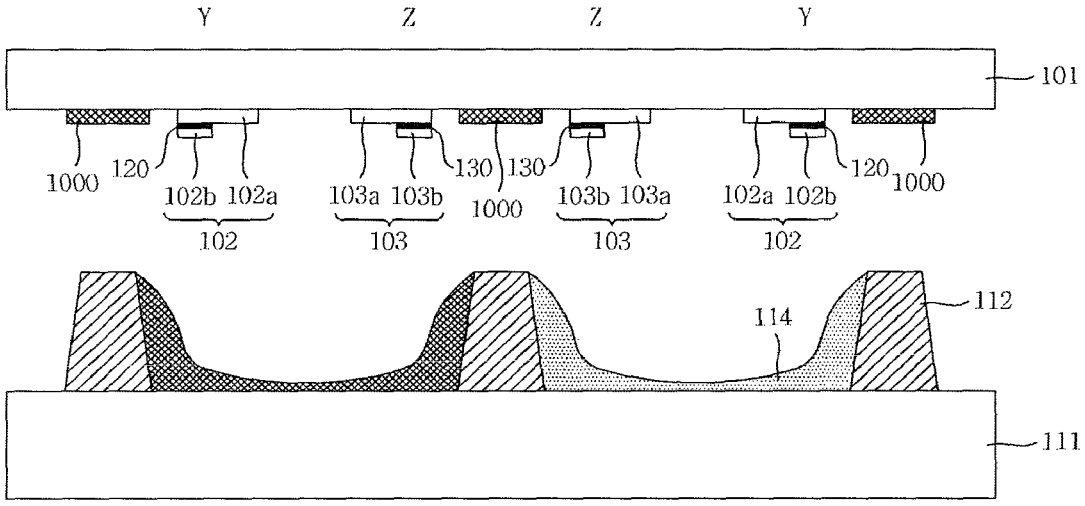
FIGS. 12A to 12C show another structure of a plasma display panel according to the exemplary embodiment.
Figure 12B:
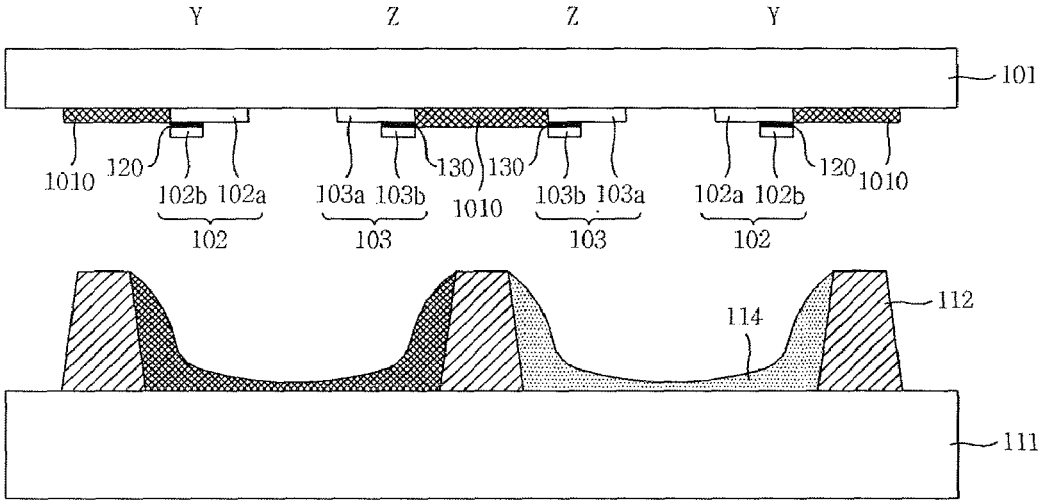
Figure 12C:
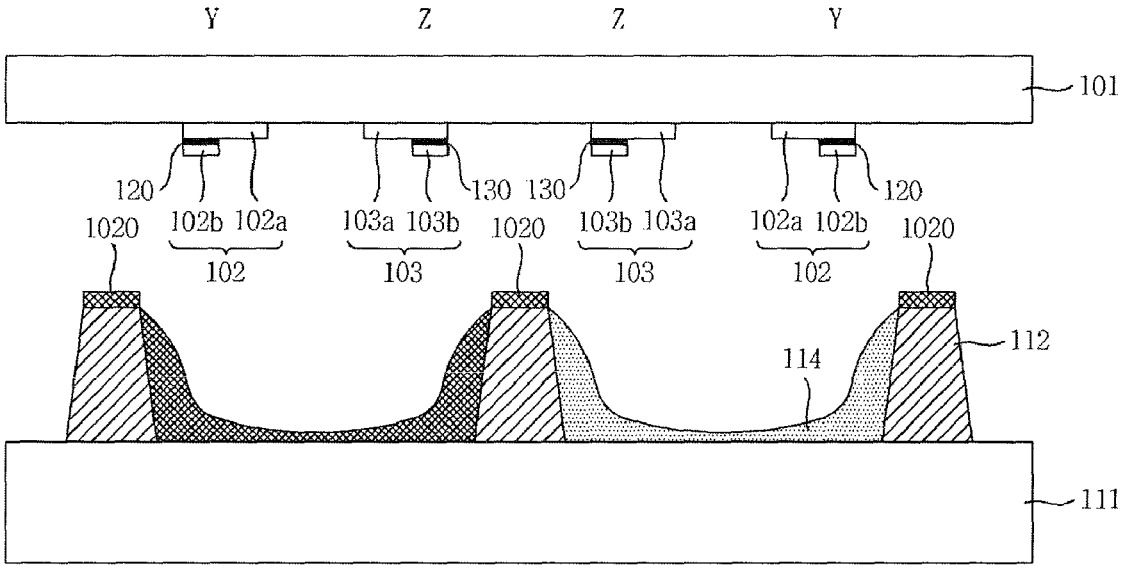

FIGS. 12A to 12C show another structure of a plasma display panel according to the exemplary embodiment.

As shown in FIG. 12A, a black matrix 1000 overlapping the barrier rib 112 is formed on the front substrate 101. The black matrix 1000 absorbs incident light and thus suppresses the reflection of light caused by the barrier rib 112. Hence, a panel reflectance is reduced and a contrast characteristic can be improved.

In FIG. 12A, the black matrix 1000 is formed on the front substrate 101. However, the black matrix 1000 may be positioned on the upper dielectric layer (not shown).

Black layers 120 and 130 are formed between the transparent electrodes 102*a* and 103*a* and the bus electrodes 102*b* and 103*b*. The black layers 120 and 130 prevent the reflection of light caused by the bus electrodes 102*b* and 103*b*, thereby reducing a panel reflectance.

As shown in FIG. 12B, a common black matrix 1010 contacting the two sustain electrodes 103 is formed between the two sustain electrodes 103. The common black matrix 1010 may be formed of the substantially same materials as the black layers 120 and 130. In this case, since the common black matrix 1010 can be manufactured when the black layers 120 and 130 is manufactured, time required in a manufacturing process can be reduced.

As shown in FIG. 12C, a top black matrix 1020 is directly formed on the barrier rib 112. Because the top black matrix 1020 reduces a panel reflectance, a black matrix may not be formed on the front substrate 101.

As described above, when a pigment is mixed with the phosphor layer, the panel reflectance can be further reduced. For instance, the first and second phosphor layers may include the red and blue pigments, respectively.

The black layers 120 and 130, the black matrix 1000, the common black matrix 1010 and the top black matrix 1020 may be omitted from the plasma display panel. Because the pigment mixed with the phosphor layer can sufficiently reduce the panel reflectance, a sharp increase in the panel reflectance can be prevented although the black layers 120 and 130, the black matrix 1000, the common black matrix 1010 and the top black matrix 1020 are omitted.

A removal of the black layers 120 and 130, the black matrix 1000, the common black matrix 1010 and the top black matrix 1020 can make a manufacturing process of the panel simpler, and reduce the manufacturing cost.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate;

a rear substrate facing the front substrate;

a barrier rib that is positioned between the front substrate and the rear substrate and partitions a discharge cell; and a phosphor layer formed on the discharge cell, the phosphor layer including a first phosphor layer having a first pigment configured to emit red light, a second phosphor layer having a second pigment configured to emit blue light, and a third phosphor layer configured to emit green light, wherein a thickness of the second phosphor layer is larger than a thickness of the first phosphor layer, wherein the first phosphor layer is configured such that, when a content of the first pigment is 0.5 part by weight, a reflectance is equal to or less than about 50% at a wavelength of 400 nm to 550 nm measured when the front substrate is removed.

2. The plasma display panel of claim 1, wherein the first pigment includes iron (Fe).

3. The plasma display panel of claim 1, wherein a content of the second pigment lies in a range between 0.01 and 5 parts by weight.

4. The plasma display panel of claim 1, wherein the second pigment includes at least one of cobalt (Co), copper (Cu), chrome (Cr) or nickel (Ni).

5. The plasma display panel of claim 1, wherein the third phosphor layer includes a third pigment.

6. The plasma display panel of claim 5, wherein a content of the third pigment lies in a range between 0.01 and 3 parts by weight.

7. The plasma display panel of claim 6, wherein the third pigment includes zinc (Zn).

8. The plasma display panel of claim 1, wherein the thickness of the second phosphor layer is 1.01 to 1.32 times the thickness of the first phosphor layer.

9. A plasma display panel comprising:

a front substrate;

a rear substrate facing the front substrate;

a barrier rib that is positioned between the front substrate and the rear substrate and partitions a discharge cell; and a phosphor layer formed on the discharge cell, the phosphor layer including a first phosphor layer emitting first color light, a second phosphor layer emitting second color light, and a third phosphor layer emitting third color light, wherein the first phosphor layer includes a first pigment, and a thickness of the second phosphor layer is 1.01 to 1.32 times a thickness of the first phosphor layer, wherein, the first phosphor layer is configured such that when a content of the first pigment is 0.5 part by weight, a reflectance is equal to or less than about 50% at a wavelength of 400 nm to 550 nm measured when the front substrate is removed.

10. The plasma display panel of claim 9, wherein the first phosphor layer includes a red pigment that emits the first color light, the second phosphor layer includes a blue pigment that emits the second color light, and the third phosphor layer includes a green pigment that emits the third color light.

11. The plasma display panel of claim 10, wherein the phosphor layer is configured such that a content by weight of at least one of the red pigment, the blue pigment, or the green pigment controls an amount of reflectance in the plasma display panel.

12. The plasma display panel of claim 11, wherein the content of the red pigment lies in a range between 0.1 and 3 parts by weight, and wherein the red pigment includes iron (Fe).

13. The plasma display panel of claim 11, wherein the content of the blue pigment lies in a range between 0.01 and 5 parts by weight, and wherein the blue pigment includes at least one of cobalt (Co), copper (Cu), chrome (Cr) or nickel (Ni).

14. The plasma display panel of claim 11, wherein the content of the green pigment lies in a range between 0.01 and 3 parts by weight, and wherein the blue pigment includes zinc (Zn).

15. The plasma display panel of claim 1, wherein the content of the first pigment lies in a range between 0.1 and 3 parts by weight.

16. The plasma display panel of claim 1, wherein, when the content of the first pigment is 0.5 parts by weight and a content of the second pigment is 1.0 parts by weight, a panel reflectance ranges from 27.5% to 29.5% at a wavelength of 500 nm to 600 nm measured in a panel state in which the front substrate and the rear substrate are coalesced with each other.

17. The plasma display panel of claim 9, wherein, when the content of the first pigment is 0.5 parts by weight and a content of the second pigment is 1.0 parts by weight, a panel reflectance ranges from 27.5% to 29.5% at a wavelength of 500 nm to 600 nm measured in a panel state in which the front substrate and the rear substrate are coalesced with each other.

* * * * *